United States Patent [19]

Willis

[11] 4,222,597

[45] Sep. 16, 1980

[54] REFUSE COLLECTING DEVICE

[76] Inventor: J. Don Willis, 301 E. Lawrence Rd., Phoenix, Ariz. 85012

[21] Appl. No.: 1,358

[22] Filed: Jan. 5, 1979

Related U.S. Application Data

[63] Continuation-in-part of Ser. No. 882,363, Mar. 1, 1978, Pat. No. 4,149,745.

[51] Int. Cl.[2] ..... A01B 1/04

[52] U.S. Cl. ..... 294/1 BA; 294/55

[58] Field of Search ..... 294/1 R, 19 R, 55, 24, 294/50.6, 51, 99, 100, 101, 1 B, 1 BA; 15/257.1, 257.6, 257.9

[56] References Cited

U.S. PATENT DOCUMENTS

| | | | |
|---|---|---|---|
| 3,796,453 | 3/1974 | Grimes | 294/1 B |
| 3,986,744 | 10/1976 | Krogstad et al. | 294/1 B |

*Primary Examiner*—James B. Marbert

*Attorney, Agent, or Firm*—Cahill, Sutton & Thomas

[57] ABSTRACT

A hollow cylindrical scoop-shaped device facilitates scooping of solid and semi-solid refuse off hard ground or vegetation covered ground through manipulation of the device by a pivotally attached handle attached forwardly of the center of gravity of the device. The refuse scooped is collected in a detachably attached trailing disposable clamp secured conventional paper sack or plastic bag protected by a guard at the bottom of the device. The handle includes a detachably attached paddle for manual use in sweeping the refuse off sidewalks and the like into the scoop.

10 Claims, 9 Drawing Figures

REFUSE COLLECTING DEVICE

This application is a continuation-in-part application of my copending application entitled "Refuse Collecting Device", Ser. No. 882,363, filed March 1, 1978 now U.S. Pat. No. 4,149,745, and describing an improvement invented by me.

The present invention relates to refuse collecting devices and, more particularly, to devices for collecting the feces of pets.

Periodically and usually daily, home owners who have pets, such as dogs and cats, must remove the feces of their pets from their yards. Often, the feces if picked up with a spade, shovel, hand trowel, or the like. Thereafter, the feces is placed within a container of some sort and ultimately dumped in a garbage can or toilet. These implements are reasonably satisfactorily useable but the process is more cumbersome than need be. Additionally, for those persons who, because of physical frailty or injury, cannot easily stoop or bend over, adequate manipulation of the implements may be difficult. Moreover, the process of depositing the picked-up feces into a container is cumbersome and at best, somewhat awkward.

Many municipalities, particularly those without a large park system, impose severe fines upon the owners of pets who allow their pets to defecate on the sidewalk. Accordingly, these owners, who exercise their pets on public sidewalks, must carry with them some means for retrieving their pet's feces or else be subject to substantial fines.

In any neighborhood, there are, despite the most stringent leash laws, animals which roam unattended. Necessarily, these animals defecate on front lawns other than that of their owner's. The results are not only unsightly but also hazardous to health. Removal of such feces must be effected by the owner.

The following United States Letters Patents are representative or various types of devices which have been invented and which are generally related to the present invention: U.S. Pat. Nos. 3,659,891, 3,703,158, 3,740,086, 3,744,453, 3,754,785, 3,757,737, 3,777,708, 3,804,488, 3,830,423, 3,868,135, 3,986,744, 3,872,831 and 4,012,067.

While these devices will, to a greater or a lesser extent, accomplish the purposes sought, they suffer from various mechanical and operational deficiencies. In example, some of the devices require specially constructed and formed collection bags; thereby, bags readily available in one's household cannot be employed. Some of the devices have attachment mechanisms for the collection bags which renders detachment of the filled collection bag difficult or which renders it necessary to physically contact the portions of the device which have come in contact with the feces picked up. Some of the devices have no means for protecting the edges of the bag opening from contacting rough ground surfaces and tearing. Others of the devices, because of the nature of the receiving opening, render it essentially physically impossible to collect feces from vegetation covered ground without strenuous manipulation. A few of the devices require that the feces be collected during the act of defecation; a seemingly absurd requirement in most situations. For those devices which have no removable collection bag, the cleaning required to remove the collected feces is extremely distasteful, particularly if the user does not live in a house where outside faucets are available.

The handle supported and operated ones of these devices are less than totally effective in removing feces from sidewalks and the like for the following reasons. To scoop up the feces, substantial downward force must be employed to distend the scoop edge sufficiently wide to accommodate the feces some distension may also be required in order to apply a sufficient scraping force to achieve effective removal of the feces. The resultant friction between the device and the sidewalk renders manipulation of the device by means of the attached handle very difficult, if not impossible.

The present invention was developed with full knowledge of the state of the prior art and particular emphasis was directed toward the development of a device which is first of all functionally adequate, employs disposable collection bags of the type available in any household and may be used upon any surface by a pivotably attached handle.

It is therefore a primay object of the present invention to provide a device for collecting animal feces in a disposable collection bag.

Another object of the present invention is to provide a refuse collecting device which detachably attaches and releasably retains any sized conventional paper sack or plastic bag.

Yet another object of the present invention is to provide a refuse collection device which may be operated by manipulation of a pivotably attached handle.

Still another object of the present invention is to provide a pivotably attached handle supporting a removable paddle for use in loading a refuse collecting device.

A further object of the present invention is to provide a refuse collecting device which incorporates a scoop, a handle and a paddle in a single useable unit.

A yet further object of the present invention is to provide a removable handle for a refuse collecting device which handle includes a removable paddle for manual manipulation in urging refuse into the device.

These and other objects of the present invention will become apparent to those skilled in the art as the description thereof proceeds.

The present invention may be described with greater specificity and clarity with reference to the following drawings, in which.

Figure 1:
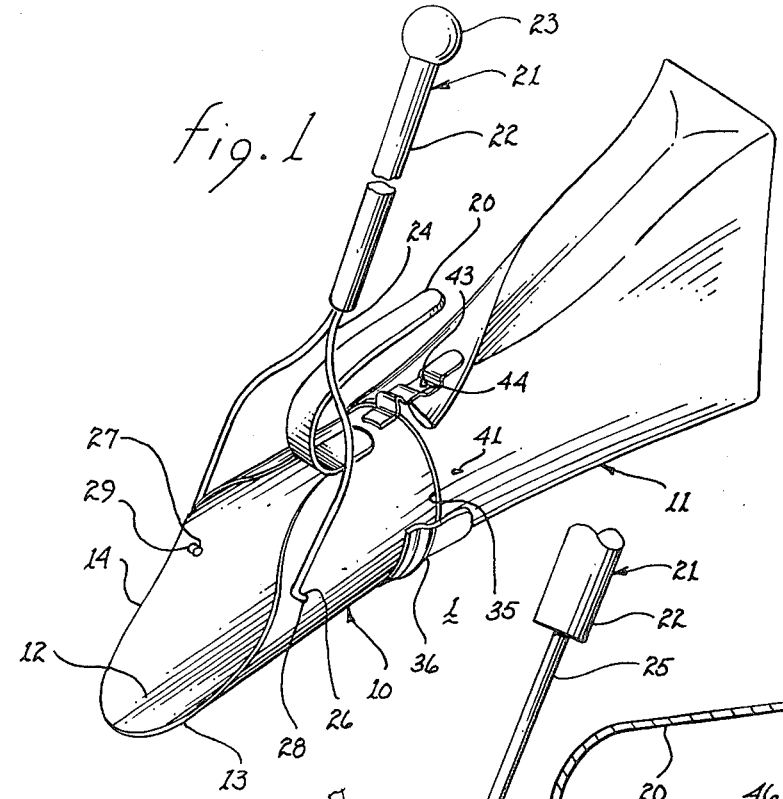
FIG. 1 is a perspective view of the refuse collecting device.

Referring to FIG. 1, there is shown a refuse collecting device 1 having a scoop 10 and a trailing collection bag 11. The scoop includes a forwardly extending snout 12 having its forwardmost point at the bottom line of the scoop. Rearwardly of the forwardmost point, edges 13 and 14 extend laterally upwardly and thence inwardly to define the overall cylindrical configuration of scoop 10. With this configuration of the forward end of the scoop, it is easy to penetrate ground covering vegetation to retrieve feces and yet the capability of retrieving feces off hard surfaces is not impaired. The use of an overall cylindrical configuration of the scoop has several advantages. First, sheet metal is readily formed into a cylinder by conventional and inexpensive processes. Second, the cylindrical configuration, aside from the material itself employed, lends a certain resiliency to the scoop not available from rectangular or triangular cross-sectional configurations.

Figure 3:
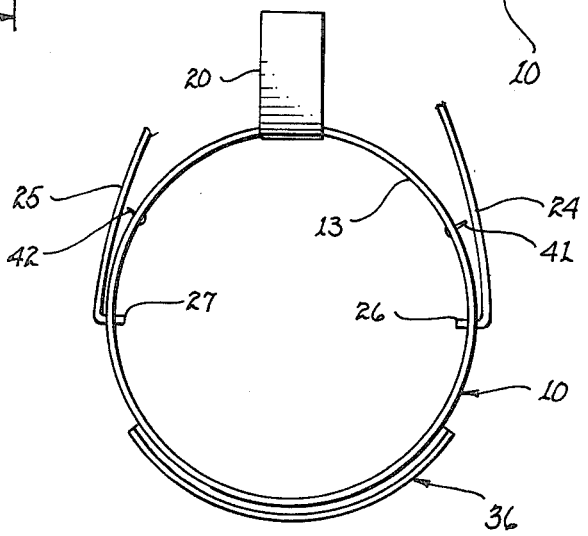
FIG. 3 is a front view, taken along lines 3—3, as shown in FIG. 2.

A handle 20, which may be of bent sheet material as illustrated or of man-made platics, is rigidly attached to the upper surface of scoop 10. This handle permits direct manipulation of the scoop to retrieve feces. An extended handle 21, which is detachably attached to scoop 10 may be employed by those persons who cannot stoop or bend over sufficiently to use handle 20. Extended handle 21 includes a shaft 22 having a handle or knob 23 disposed at the upper end thereof. Wire elements 24 and 25 extend downwardly from the lower end of handle 22 to straddle scoop 10 (see FIG. 3). Ends 26 and 27 of these wire elements are bent inwardly toward one another for penetrating engagement with apertures 28 and 29 disposed in opposed sides of scoop 10. By positioning apertures 28 and 29 forward of the center of gravity of refuse collecting device 1, lifting of the device by extended handle 21 will cause a downward tilting of the rear end of the scoop and encourage translation of any collected refuse from snout 12 into collecting bag 11.

Figure 2:
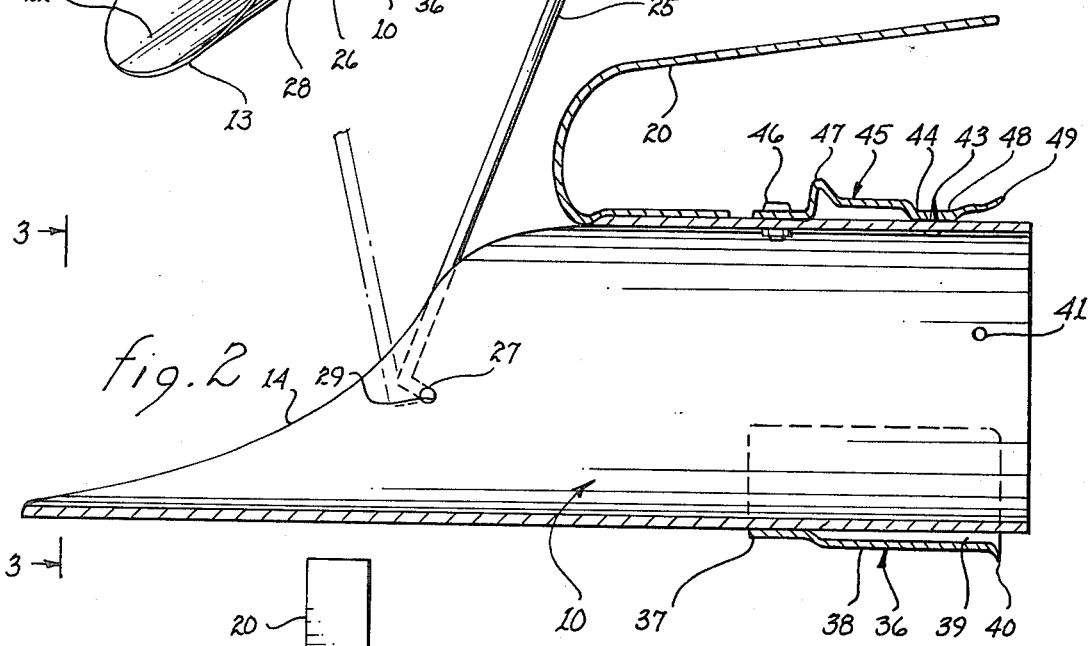
FIG. 2 is a cross-sectional view taken along the longitudinal axis of the device.

Referring particularly to FIGS. 1 and 2, the means for attaching collecting bag 11 will be described. Every household has surplus paper bags which are obtained during purchases at stores. These bags come in a variety of sizes. Additionally, many items are purchased which are already encased within plastic bags, which plastic bags also come in various sizes. To render refuse collecting device 1 as utilitarian as possible, the mechanism for attaching collection bag 11 was developed to render it useful with bags having variously sized openings. Additionally, the refuse collecting device of the present invention is often used on lawns which may be wet or damp from dew, rainfall, etc. It is therefore encumbent upon the collection bag to be as protected as possible from tearing due to reduced strength after being wetted. Moreover, the collection bags, whether of paper or of plastic, will generally easily tear if the edges thereof catch upon obstructions such as roots, rocks, etc.

As depicted in FIG. 1, opening 35 of the collection bag encircles the rear of scoop 10. The lower edge of the opening, extending about the bottom portion of the scoop is disposed within a rearwardly opening guard 36 (see also FIGS. 2 and 3). Guard 36 includes a forward curved section 37 attached to the exterior surface of the scoop by welding, bonding or other means. A radially extended section 36 trails section 37 and defines, in conjunction with the exterior cylindrical surface of scoop 10, a channel 39. The rear edge 40 of section 38 may be bent radially outwardly or the section may be flaired.

The function and purpose of channel 39 is that of slidably receiving the lower edge of the collection bag and, through section 38, protecting the edge of the bag from catching upon any surface discontinuities during operation of the refuse collecting device. The function and purpose of radially extended edge 40 is that of facilitating insertion of the edge of the collection bag within channel 39. It also serves a secondary function of deflecting any obstructions away from the trailing exposed surface of the collection bag extending rearwardly from the guard.

Clamping of the collection bag to the scoop is effected by a spring clamp 45 constructed from resilient material. The clamp includes attachment means 46, such as a sheet metal screw or a nut and bolt, for attaching the forward end of the clamp to the upper center line of the scoop. By convoluting clamp 45, as shown by convolution 47, the requisite resiliency and spring-like action of the clamp can be achieved. A downwardly extending section 48 bears toward exterior surface of scoop 10 and provides a clamping force upon any material inserted intermediate the clamp and the scoop surface. A collection bag piercing prong 43 may extend from scoop 10 to engage aperture 44 in clamp 45 and penetratingly engage the bag to lock the bag in place. Rear end 49 of the clamp may be bent upwardly to facilitate insertion of a part of the collection bag beneath the clamp.

To help maintain the bag about the scoop, prongs, such as prongs 41 and 42 may extend radially from the scoop for penetrating engagement with the overlying edge of the bag.

To attach a collection bag to scoop 10, a portion of the bag opening is inserted within guard 38 and the diametrically opposed portion of the bag opening is forced intermediate clamp 45 and the underlying surface of the scoop. In the event the opening of the collection bag is greater in diameter than the diameter of exterior surface of the scoop, the bag is attached as described above and the excess of the bag material is drawn tight on one side or the other of clamp 45. The excess material is folded over adjacent the underlying portion of the bag and inserted beneath clamp 45; thereby, clamp 45 maintains the folded over portion 55 (see FIG. 1) in place to preclude expansion of the opening and disengagement of the bag from the scoop.

After the refuse to be collected has been retrieved by scoop 10 and slidably translated into collection bag 11, the upper end of the collection bag may be grasped by one hand, the other hand holding onto handle 20 of the scoop, and the bag is pulled rearwardly out of engagement with the scoop. Depending upon the holding power of clamp 45, it may or may not have to be lifted; it is expected that disengagement with the prongs is effected by allowing the prongs to tear free. Thereafter, the top of the bag can be folded or rolled over and disposal of the refuse bag may be undertaken. It may be noted that the only portion of scoop 10 coming in contact with the refuse during collection thereof is snout 12. No other external portion of the scoop necessarily contacts the refuse. After the refuse has been collected in collection bag 11, the bag is simply and readily disengaged from the scoop with no difficulty. Prior to the next use of the scoop, it may, of course, be cleaned, but such cleaning is not necessary to avoid manual contact with refuse remnants from the last use of the refuse collecting device.

In some situations, it may be necessary to apply a downward force upon scoop 10 in order to establish a sufficient scraping force to properly and effectively remove refuse. This problem usually arises when the refuse is deposited upon hard surfaces, such as sidewalks and the like. Such scraping necessarily creates a substantial friction force intermediate the scoop and the hard surface. Because of the friction force, it may be awkward or somewhat difficult to use the scoop if extended handle 21, rather than handle 20, is employed to manipulate the scoop.

Figure 4:
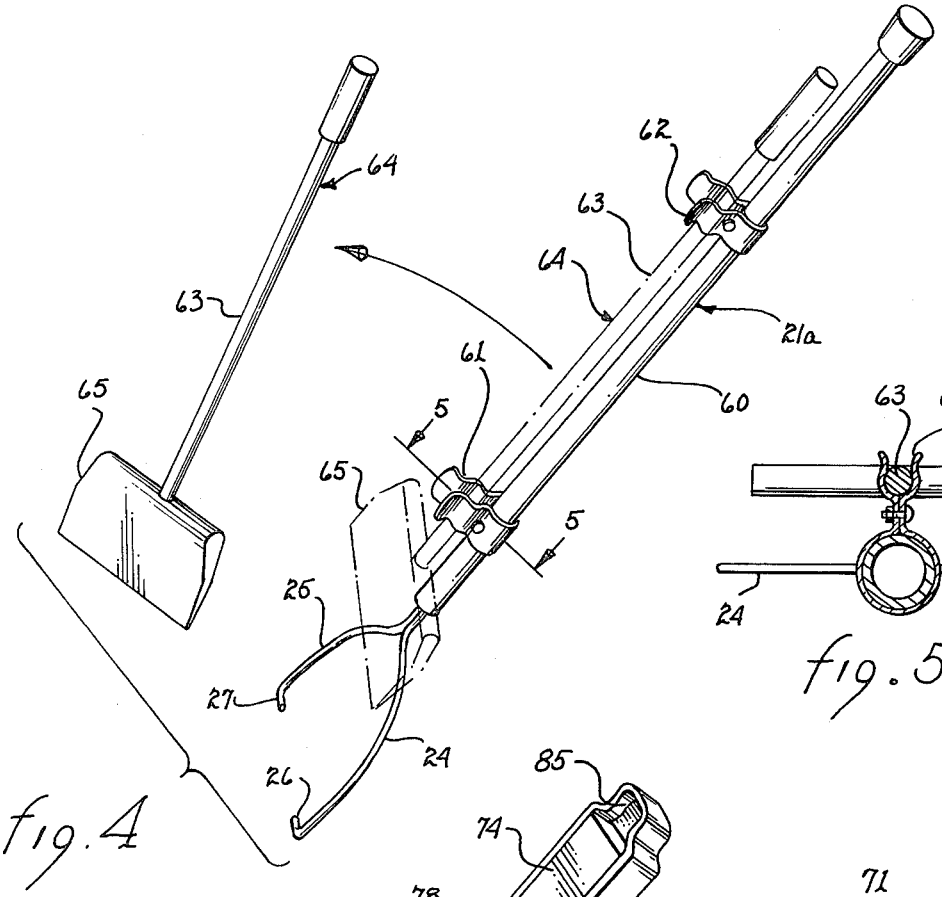
FIG. 4 is a perspective view of a detached attachable handle.
Figure 5:
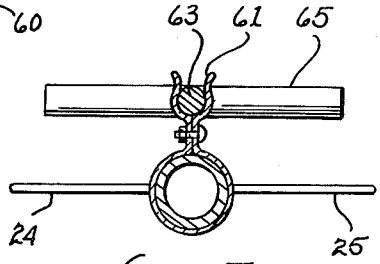
FIG. 5 is a cross-sectional view taken along lines 5—5 as shown in FIG. 4.

To aid in collection of the refuse by scoop 10 under these circumstances, a handle 21*a*, as shown in FIG. 4, may be employed. This handle includes a shaft 60 supporting wire elements 24 and 25 having ends 26 and 27, respectively, for pivotal engagement with scoop 10. Clamps 61 and 62 extend from shaft 60 and support haft 63 of paddle 64. A sweep member 65 is attached to the lower end of haft 63.

Clamps 61 and 62 are oriented about shaft 60 to position paddle 64 forwardly of the shaft after attachment of the latter to scoop 10. Thereby, a user can readily detach the paddle with his/her free hand and sweep the refuse into the scoop in the manner of loading a dust pan.

Figure 6:
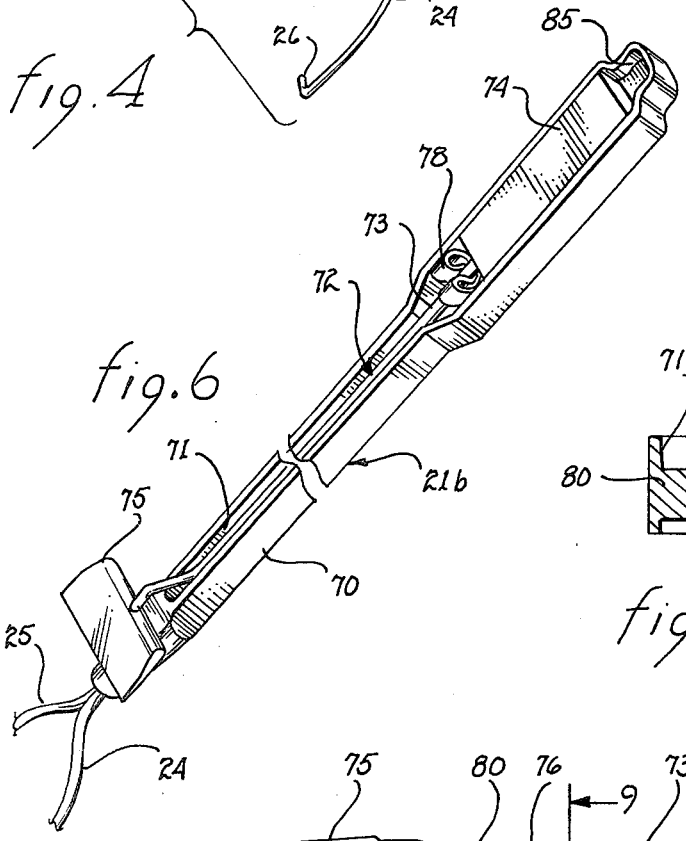
FIG. 6 is a perspective view of a further detached attachable handle.
Figure 8:
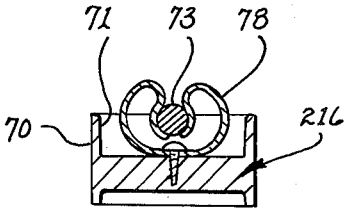
FIG. 8 is a cross-sectional view taken along lines 8—8, as shown in FIG. 7.
Figure 9:
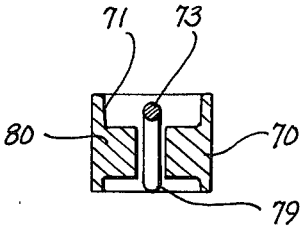
FIG. 9 is a cross-sectional view taken along lines 9—9, as shown in FIG. 7.
Figure 7:
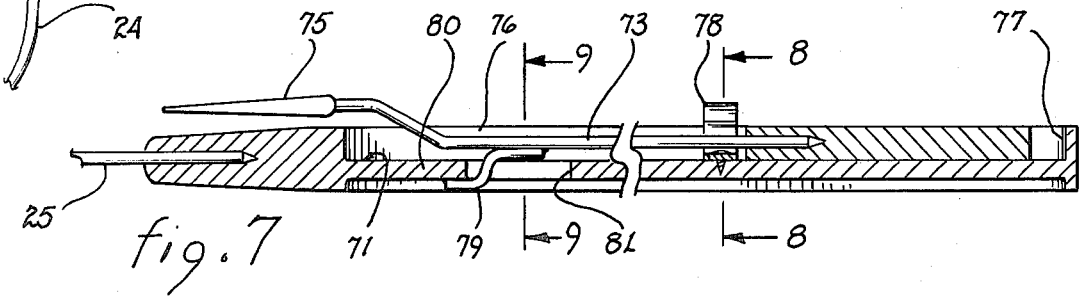
FIG. 7 is a partial cross-sectional view of the handle shown in FIG. 6.

A variant of the handle is illustrated in FIG. 6, which variant is identified by the numeral 21*b*. Handle 21*b* includes a shaft 70 supporting wire elements 24 and 25 for detachable pivotal engagement with scoop 10. The shaft includes a recess 71 formed therein to receive and removably retain a paddle 72, as further illustrated in FIGS. 7, 8 and 9.

The paddle includes a haft 73 having a hand grip 74 disposed at one end and a sweel member 75 disposed at the opposed end. Recess 71 includes an elongated section 76 for receiving the haft and a laterally expanded section 77 for receiving hand grip 74. The depth of the recess is sufficient to receive a substantial length of the haft and the complete hand grip. The lower end of haft 73 is joggled to bring the lower end out of the recess and support sweep member 75 external to handle 70.

Paddle 72 is maintained lodged within handle 70 by clamp means 78 releasably retaining haft 73 and by a joggled key 79 attached to and extending from the haft. Key 79 is penetrably disposed through a web 80 in handle 70 via aperture 81 to lockingly engage the opposed surface of the web on sliding movement of the paddle with respect to shaft 70. A recess 85 is located at the upper end of handle 21*b* to provide finger access to the hand grip 74 and facilitate lifting of the paddle from within the handle.

Removal of paddle 72 from handle 21*b* is effected by inserting one's finger in recess 85 to lift the hand grip and pivot the paddle about key 79, which upward movement of the paddle results in disengagement of the paddle with clamp 78. On sliding the paddle to the rear, key 79 will disengage from the adjacent web and the paddle can be lifted out of recess 71. Reinsertion of the paddle is achieved by reversing the above steps.

It may be noted that as sweep member 76 may become soiled upon use, such soilage will not be transferred to handle 21*b*.

It is presently anticipated that handle 21*b* is to be manufactured from man-made plastic materials using a molding technique. Thereby, the total mass of the handle may be minimized and yet no impairment of strength results if suitable flanges and webs are incorporated in the handle.

From the above descriptions, it will become apparent that both handles 21*a* and 21*b*, including the respective encased paddles, define structures which are readily hand maneuverable and manipulatable and yet provide ready access to the employment of the attached paddle when needed. Preferrably, handles 21*a* and 21*b* are attached to scoop 10 in such a manner as to place the respective paddle facing forwardly to facilitate removal and reattachment of the paddle. Moreover, such positioning of the paddles maintains sweep member 75 out of contact with the bag trailing the scoop.

From the above description, it will become apparent that the use of refuse collecting device 1 is equally facile whether handle 20 ot handles 21, 21*a* or 21*b* are employed during collection of the refuse.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A manually operated refuse collecting device for collecting refuse in a trailing disposable bag, said device comprising in combination:

(a) a cylindrical scoop having the longitudinal axis thereof extending from the front to the rear for scooping refuse off a surface, said scoop including a forwardly extending snout disposed along the bottom thereof and a rear section for circumscribingly receiving the opening of the bag;

(b) handle means secured to said scoop for manipulating said device, said handle means including detachable paddle means for aiding in directing refuse into said scoop;

(c) a rearwardly opening guard having a front part secured to a lower cylindrical rear section of said scoop for protecting the bottom front edge region of the bag, said guard including a rear part radially extended from said scoop for defining a channel adjacent the lower bottom surface of said scoop for receiving and retaining the lower front edge region of the bag; and (d) a resilient member disposed upon said scoop in general alignment with the longitudinal axis of said scoop and including clamp means for bearing against an upper front edge region of the bag to retain the bag attached about the exterior surface at the rear section of said scoop, said resilient member further including attachment means for securing the forward end of said resilient member to said scoop;

whereby, the bag is detachably attached to said scoop by said guard and said clamp means.

2. A manually operated refuse collecting device for collecting refuse in a trailing disposable bag, said device comprising in combination:

(a) a scoop for scooping refuse off a surface, said scoop including a forwardly extending snout disposed along the bottom thereof and a rear section for circumscribingly receiving the opening of the bag;

(b) handle means secured to said scoop for manipulating said device, said handle means including:

i. pivot means for pivotally attaching said handle means to said scoop;

ii. paddle means for use in directing refuse into said scoop; and iii. attachment means for releasably retaining said paddle means mounted to said handle means during non use of said paddle means;

(c) a rearwardly opening guard disposed at the bottom of the rear section of said scoop for protecting the bottom front edge region of the bag, said guard defining a channel adjacent the lower bottom surface of said scoop for receiving and retaining the lower front edge region of the bag; and (d) clamp means disposed upon said scoop for clamping an upper front edge region of the bag adjacent the exterior surface of said scoop;

whereby, the bag is detachably attached to said scoop by said guard and said clamp means.

3. The device as set forth in claim 2 wherein said paddle means comprises a haft and a sweep member.

4. The device as set forth in claim 3 wherein said attachment means comprises clasp means for securing said haft to said handle means.

5. The device as set forth in claim 3 wherein said haft includes means for maintaining said sweep member in a non contacting relationship with said handle means.

6. A manually operated refuse collecting device for collecting refuse in a trailing disposable bag, said device comprising in combination:

(a) a scoop for scooping refuse off a surface, said scoop including a forwardly extending snout disposed along the bottom thereof and a rear section for circumscribingly receiving the opening of the bag;

(b) handle means secured to said scoop for manipulating said device, said handle means including:

i. pivot means for pivotally attaching said handle means to said scoop;

ii. paddle means for use in directing refuse into said scoop, said paddle means comprising a haft having a handgrip and a sweep member;

iii. a recess for receiving said haft and said handgrip; and iv. attachment means for releasably retaining said paddle means mounted to said handle means during non use of said paddle means;

(c) a rearwardly opening guard disposed at the bottom of the rear section of said scoop for protecting the bottom front edge region of the bag, said guard defining a channel adjacent the lower bottom surface of said scoop for receiving and retaining the lower front edge region of the bag; and (d) clamp means disposed upon said scoop for clamping an upper front edge region of the bag adjacent the exterior surface of said scoop;

whereby, the bag is detachably attached to said scoop by said guard and said clamp means.

7. The device as set forth in claim 6 wherein said haft includes a key for locking engagement with said handle means.

8. The device as set forth in claim 7 wherein said attachment means includes clasp means for engaging said haft to prevent unlocking of said key with said handle means.

9. The device as set forth in claim 6 wherein said haft includes means for maintaining said sweep member in a non contacting relationship with said handle means.

10. The device as set forth in claim 9 wherein said maintaining means comprises a joggled section of said haft.

* * * * *